US007427226B1

(12) United States Patent
Deal

(10) Patent No.: US 7,427,226 B1
(45) Date of Patent: Sep. 23, 2008

(54) FLOATING CUP BREAST SUPPORT GARMENT

(75) Inventor: Beverly Ann Deal, Ventura, CA (US)

(73) Assignee: Ce Soir Lingerie Co., Inc., Ventura, CA (US)

( * ) Notice: Subject to any disclaimer, the term of this patent is extended or adjusted under 35 U.S.C. 154(b) by 0 days.

(21) Appl. No.: 11/894,218

(22) Filed: Aug. 20, 2007

(51) Int. Cl.
*A41C 3/00* (2006.01)
*A41C 3/12* (2006.01)

(52) U.S. Cl. ..... 450/65; 450/60; 450/61

(58) Field of Classification Search ..... 450/60, 450/61, 65, 67, 68, 70, 74, 78
See application file for complete search history.

(56) References Cited

U.S. PATENT DOCUMENTS 2,180,391 A * 11/1939 Blair ..... 450/65
2,912,985 A * 11/1959 Plehn ..... 450/65
2,983,274 A * 5/1961 Plehn ..... 450/65

* cited by examiner

*Primary Examiner*—Gloria Hale
(74) *Attorney, Agent, or Firm*—Freilich, Hornbaker & Rosen

(57) ABSTRACT

A women's breast support garment, e.g., bra, configured to promote wearer comfort by allowing a breast cup to move multi-directionally, or float, relative to a torso member. The bra construction is characterized by a limp intermediate strip at the junction between the lower edge of each breast cup and the upper edge of a torso member.

5 Claims, 4 Drawing Sheets

FLOATING CUP BREAST SUPPORT GARMENT

FIELD OF THE INVENTION

This invention relates generally to women's breast support garments, e.g., bras, and more particularly to a breast support garment configured to promote wearer comfort by allowing a breast cup to move multi-directionally, or float, relative to a torso member.

BACKGROUND OF THE INVENTION

The prior art is replete with various garments, hereinafter generically referred to as "bras," for supporting a woman's breasts. Typically, a bra is constructed of fabric material and is comprised of a pair of breast cups and a torso member (e.g., a band or adhesive strip) connected to the cups. A typical bra may also include a pair of shoulder straps and a wire associated with each cup for lifting and/or supporting the cups and breasts therein. Traditional bra construction typically requires multiple operations to stitch, or otherwise connect, the various pieces of fabric to form the finished bra, resulting in elevated manufacturing costs. In an effort to reduce manufacturing costs and provide a smoother seamless garment, bras have been recently introduced which are constructed by molding sheet material into the desired bra shape; e.g., see U.S. Pat. No. 7,192,332.

For traditional fabric bras, and particularly for modern molded bras, the junction between the bra cups and torso member typically restricts relative movement between the wearer's breasts and torso. As a result, the wearer may experience discomfort when engaging in certain physical activities.

SUMMARY OF THE INVENTION

The present invention is directed to a bra construction configured to allow each breast support cup to float, i.e., move multidirectionally, relative to a torso member, for enhancing wearer comfort. More particularly, a bra construction in accordance with the present invention, provides a junction between the lower edge, or margin, of each breast cup and the upper edge, or margin, of a torso member which affords freedom of movement relative to three mutually perpendicular directions, i.e., side-to-side (or "lateral"), up-and-down (or "longitudinal"), and in-and-out (or "thrust").

In a preferred embodiment of the invention, a lower cup edge is joined to an upper torso member edge by an intermediate strip which allows relative movement between the respective edges in said lateral, longitudinal, and thrust directions. The intermediate strip is selected to be limp, or flexible, in all three directions relative to the cup and torso member edges.

In a first preferred embodiment, the intermediate strip comprises limp material such as a light cotton lace. However, it should be understood that the limp intermediate strip can be variously formed; e.g., it can be formed by spaced threads or by sheet material punctured by a pattern of openings to form a flexible mesh.

In alternative embodiments, the intermediate strip need not comprise a separate component independent of the cups and torso member. Indeed, the intermediate strip could be formed integral with a cup or torso member. For example, in a one piece molded bra, a pattern of openings can be formed along a strip between the cup and torso member portions to enhance the limpness at the joint, i.e., considerably reduce the firmness of the strip relative to the adjacent margin areas of the cups and torso member.

DETAILED DESCRIPTION OF THE INVENTION

Figures 1, 2:
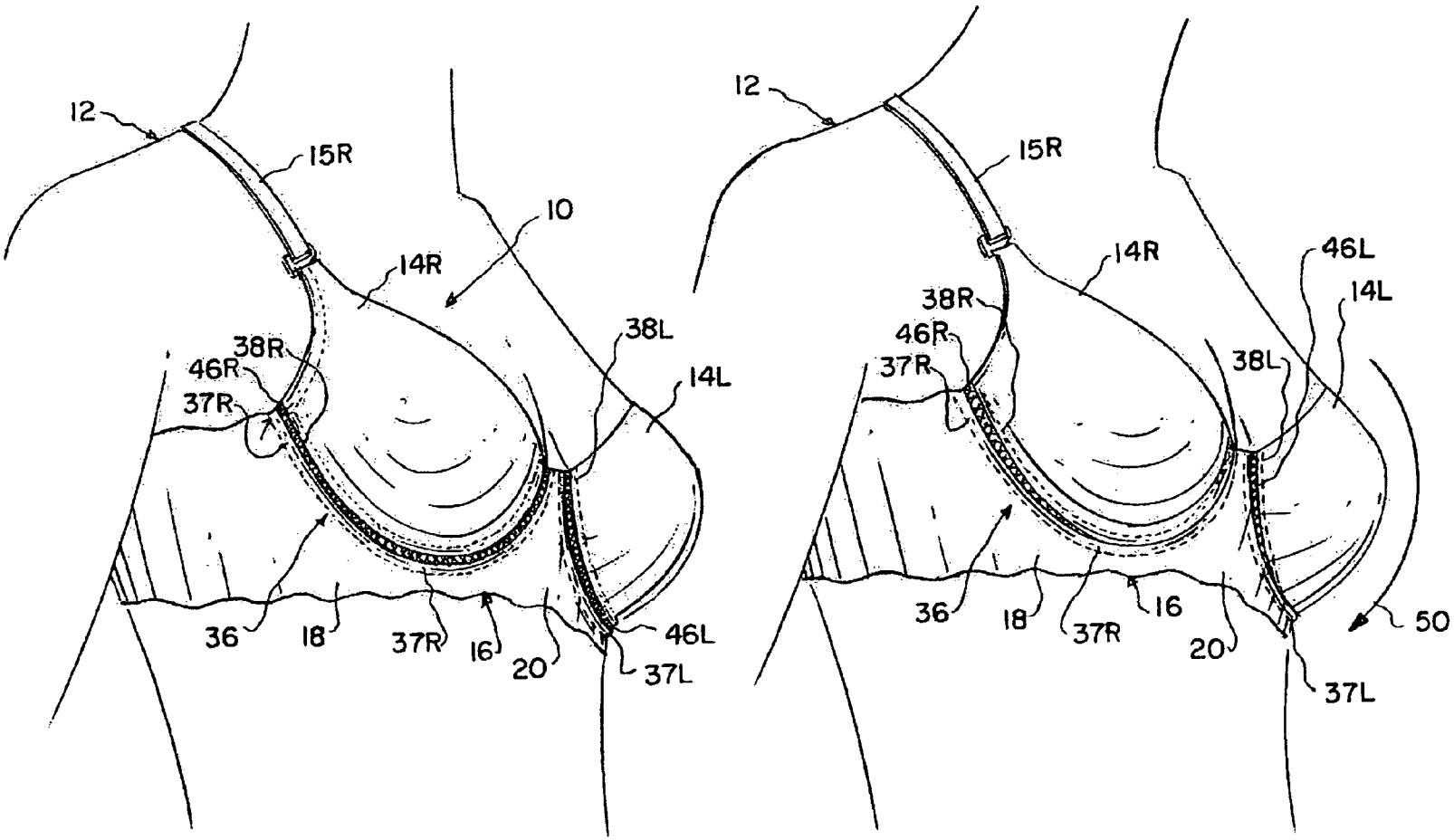
FIG. 1 is a perspective view of a user wearing a preferred bra embodiment in accordance with the present invention.
FIG. 2 is a perspective view similar to FIG. 1 showing movement of the bra's breast cups relative to the bra's torso member as the wearer bends forward.
Figures 3, 4:
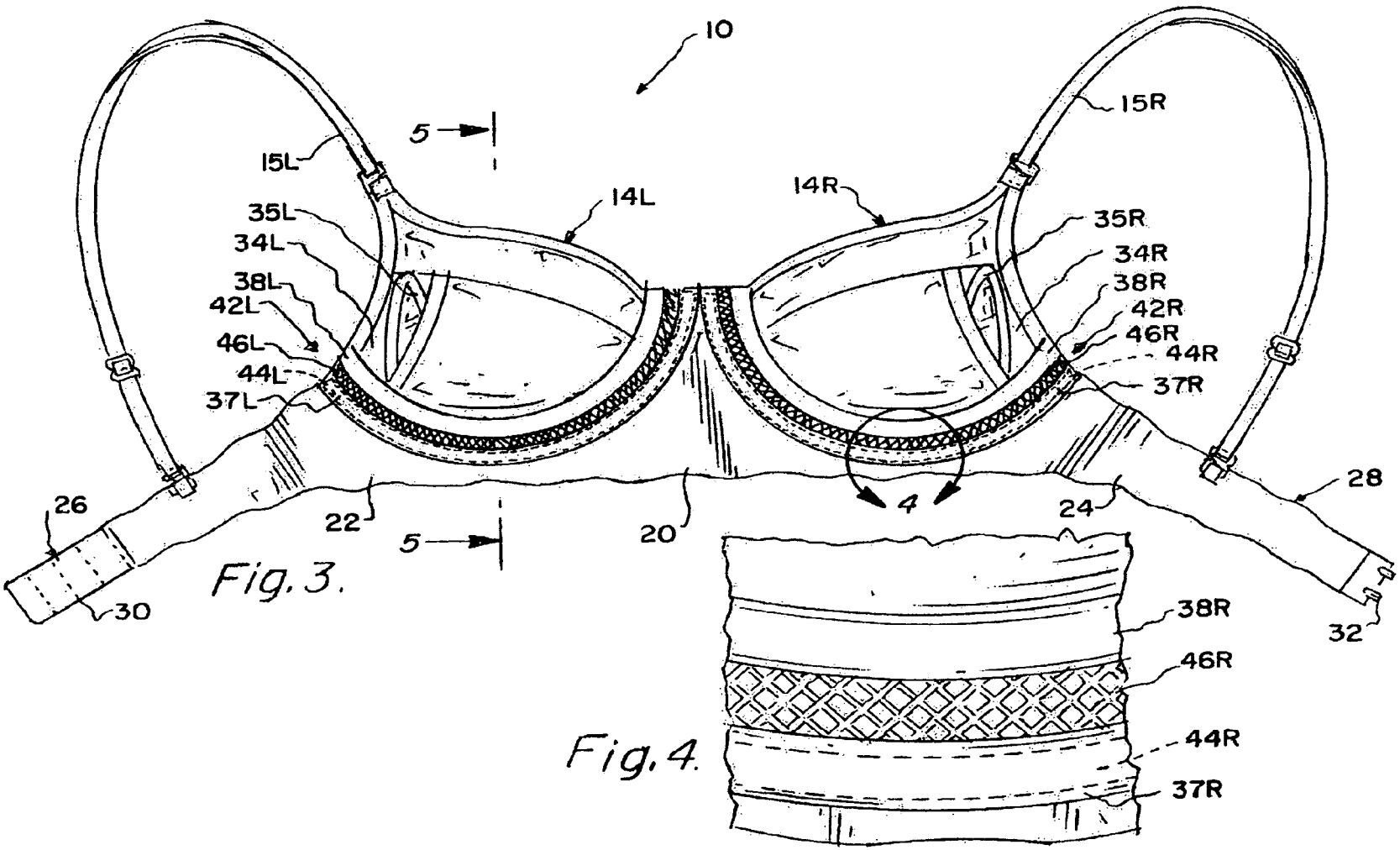
FIG. 3 is a rear view of the preferred bra of FIG. 1.
FIG. 4 is an enlarged view of a portion of FIG. 3, enclosed within the arc 4, showing the junction between the bra's breast cup and torso member.

Attention is initially directed to FIGS. 1 and 3 which illustrate a preferred bra embodiment 10 in accordance with the present invention worn by a woman 12. The bra 10 is primarily comprised of a left cup 14L, a right cup 14R, optional left and right shoulder straps 15L, 15R, and a torso member 16. The primary function of the torso member 16 is to retain the cups 14L, 14R adjacent to the wearer's breast. Although the torso member 16 can be variously constructed, the exemplary torso member illustrated in FIGS. 1-3 comprises a band 18 configured to fasten/unfasten adjacent the wearer's back. The band 18 includes a center portion 20, a left portion 22, and a right portion 24. The free ends 26, 28 of the left and right band portions respectively carry mating fasteners 30, 32.

The torso member band 18 can be alternatively constructed, as is well known in the art, to fasten/unfasten adjacent the wearer's chest. As a further alternative, the band 18 can be formed of sufficiently elastic material to define a closed loop without fasteners. Still further, the torso member 16 can comprise strips of fabric configured to be adhered to the wearer's body to adequately retain the cups 14L, 14R adjacent to the user's breasts.

As also shown in FIG. 3, the bra cups may optionally include open or sealed pockets 34L, 34R for accommodating liquid, gel, or material filled pads 35L, 35R.

Regardless of the particular configuration of the torso member 16, it includes an upper edge, or margin, 36 having arcuate portions 37L, 37R configured to join lower arcuate edge, or margin, portions 38L, 38R of the cups 14L, 14R. In traditional bra constructions, the junction between a cup and a torso member is formed by stitching. However, various alternative adhesion techniques can also be used. In the case of a single piece molded bra, the junction often comprises a strip area integrally formed with the cups and torso member. Regardless of how such junctions have been formed, they typically restrict relative movement between the wearer's breasts and torso. As a consequence, the wearer may experience discomfort when engaging in certain physical activities. This discomfort may be most noticeable in bras which incorporate an under-cup wire to enhance breast lift and cleavage.

The present invention is directed to a bra construction which enhances user comfort by introducing limited multidirectional freedom of movement at the junction between a bra torso member and breast support cups. In accordance with the present invention, the junction comprises a strip area provided between the torso member and each breast cup which is occupied by limp material connected both to the torso margin and to the cup margin.

More particularly, attention is directed to the preferred bra 10 rear view FIG. 3 which shows junctions 42L, 42R between the respective cup margins 38L, 38R and the torso margin portions 37L, 37R. An under-cup wire 44L, 44R may be incorporated in each torso margin as represented in dashed line. In accordance with the present invention an intermediate strip of material 46L, 46R is incorporated between each arcuate cup margin 38L, 38R and the torso margin portions 37L, 37R.

The material strips 46L, 46R are selected to be more supple, or limp, than the adjacent cup 14 and torso member 16 edges in three mutually perpendicular directions, i.e., side-to-side ("lateral") up-and-down (longitudinal"), and in-and-out ("thrust").

Figure 5:
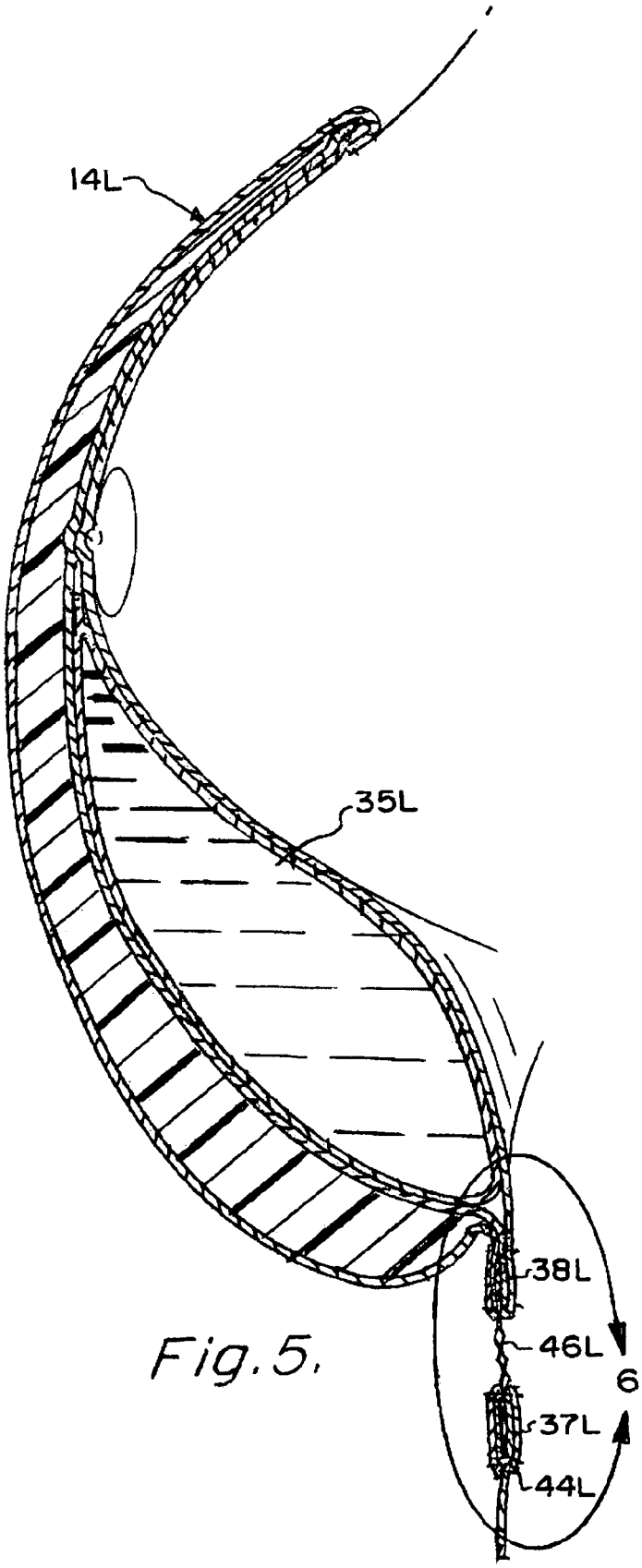
FIG. 5 is an enlarged sectional view taken substantially along the plane 5-5 of FIG. 3.
Figure 6:
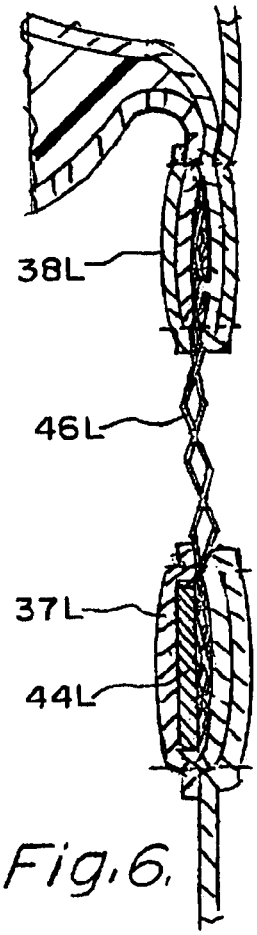
FIG. 6 is an enlarged view of a portion of FIG. 5, enclosed within the arc 6, showing a limp strip mounted at the junction between the bra's breast cup and torso member.
Figure 7:
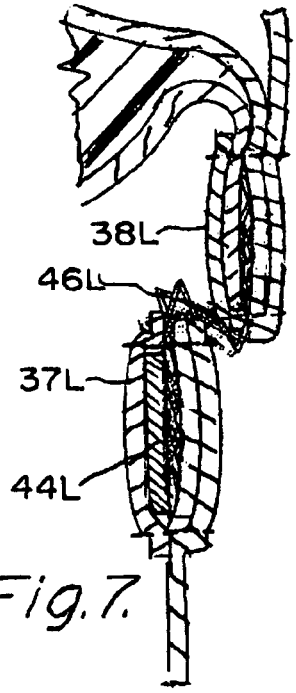
FIG. 7 is a view similar to FIG. 6 but showing the strip folded to accommodate relative movement between the breast cup and torso member.

In the preferred embodiment depicted in FIGS. 1-3, the material strip 46R (FIG. 3) is shown as comprising a strip of light material, e.g., cotton lace, which is limp in the aforementioned multiple directions. As a consequence of this multidirectional limpness of strips 46L, 46R, breast cups 14L, 14R can exhibit freedom of movement relative to the torso member band 18. For example, if the wearer of FIGS. 2 and 5, shown in the upright position bends or thrusts forward, as represented by arrow 50 in FIG. 2, the material strips 46L (shown), 46R (not shown) can fold as represented by the transition from FIG. 6 to FIG. 7.

Although the intermediate strips 46L, 46R are preferably formed of a ribbon of lace material, it should be understood that they can be alternatively formed, e.g., of spaced threads or any loosely woven fabric.

Figure 9:
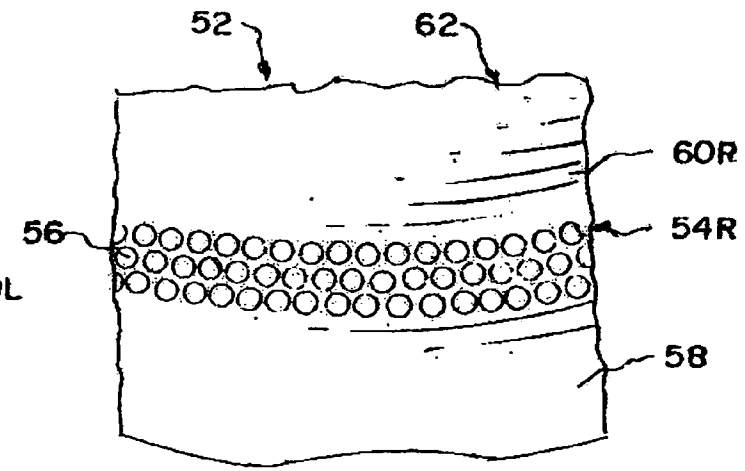
FIG. 9 is an enlarged view of a portion of FIG. 8, enclosed within the arc 9, showing a pattern of openings formed between molded cup and torso member portions.
Figure 8:
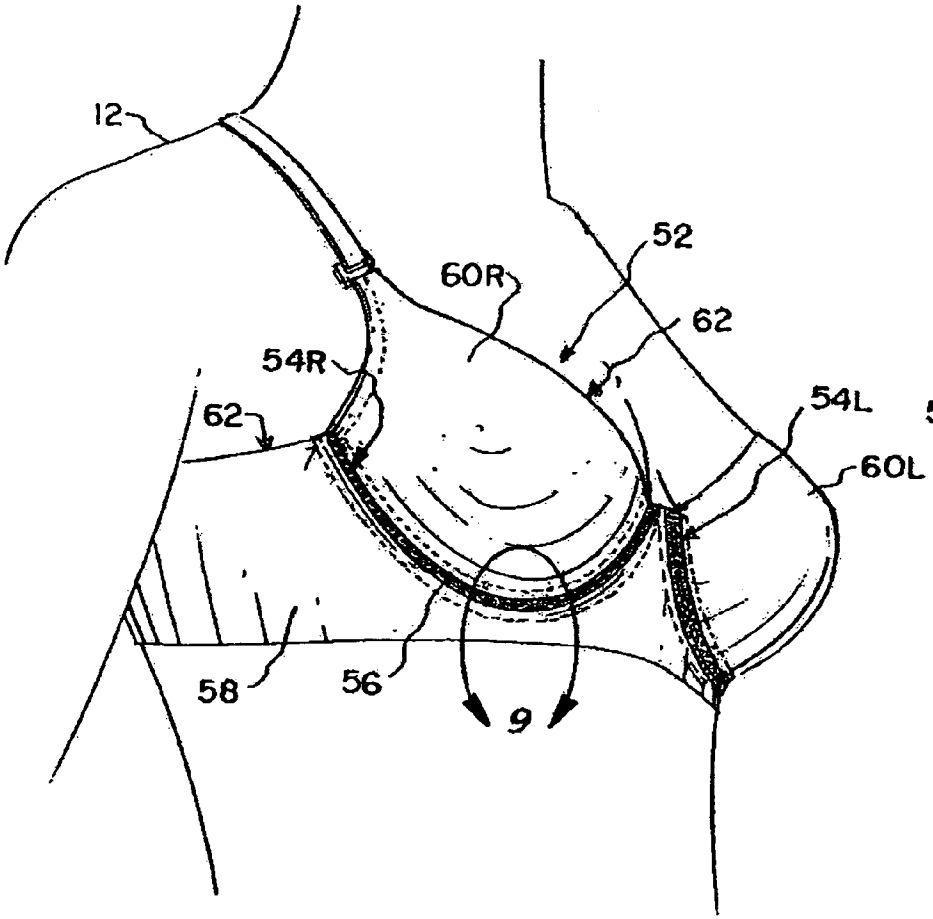
FIG. 8 is a perspective view of a user wearing an alternative embodiment of the present invention.

As a further alternative, particularly applicable to a molded bra 52 (FIGS. 8 and 9), the intermediate strips 54L, 54R can be formed by puncturing, or by otherwise creating (e.g., laser cutting) a pattern of openings 56 along a strip area 54L, 54R between the torso member 58 and each cup 60L, 60R. This pattern of opening 56 functions to reduce the firmness of the bra material 62 in multiple directions to permit the cups 60L, 60R to move relative to the torso member 58.

Intermediate strip areas 46L, 46R and/or 54L, 54R have a width dimension within a range of 1/16 inch to one inch in preferred embodiments.

From the foregoing, it should now be appreciated that applicant has described a bra construction which can enhance wearer comfort by allowing greater freedom of movement of bra cups relative to a torso member. Although only a limited number of specific embodiments have been illustrated and described, it is recognized that modifications and variations will readily occur to persons skilled in the art which fall within the spirit and intended scope of the invention as defined by the appended claims.

What is claimed is:

1. A floating cup bra construction comprising:

a torso band configured for retention immediately adjacent to a wearer's torso, said torso band having an upper edge;

a left cup configured to accommodate a wearer's left breast, said left cup having an upper edge and a lower edge;

said left cup being connected to said torso band solely by a left strip of limp material joining said left cup lower edge to said torso band upper edge;

said left strip of limp material being less stiff in three mutually perpendicular directions than said left cup lower edge and said torso band upper edge to permit relative movement between said left cup and said torso band in each of said three directions;

a right cup configured to accommodate a wearer's right breast, said right cup having an upper edge and a lower edge;

said right cup being connected to said torso band solely by a right strip of limp material joining said right cup lower edge to said torso band upper edge;

said right strip of limp material being less stiff in three mutually perpendicular directions than said right cup lower edge and said torso band upper edge to permit relative movement between said right cup and said torso band in each of said three directions; and wherein said left cup and right cup upper edges are structurally isolated from said torso band.

2. The bra construction of claim 1 wherein each of said limp strips comprises an open weave limp fabric.

3. The bra construction of claim 1 wherein each of said limp strips comprises multiple spaced threads.

4. The bra construction of claim 1 wherein each of said limp strips comprises sheet material punctured by a plurality of openings.

5. The bra construction of claim 1 wherein each of said limp strips has a width of between 1/16 inch and one inch.

* * * * *